US008408611B2

(12) United States Patent
Takagai et al.

(10) Patent No.: US 8,408,611 B2
(45) Date of Patent: Apr. 2, 2013

(54) VEHICLE DOOR HANDLE DEVICE

(75) Inventors: Hiroyuki Takagai, Saitama (JP); Yuujiro Tashima, Saitama (JP); Hiroshige Tanaka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 511 days.

(21) Appl. No.: 12/648,451

(22) Filed: Dec. 29, 2009

(65) Prior Publication Data

US 2010/0171325 A1 Jul. 8, 2010

(30) Foreign Application Priority Data

Jan. 8, 2009 (JP) ..... 2009-002548

(51) Int. Cl.
*E05B 3/00* (2006.01)

(52) U.S. Cl. ..... 292/336.3; 292/DIG. 23; 292/DIG. 65; 292/DIG. 41

(58) Field of Classification Search ..... 292/336.3, 292/DIG. 53, DIG. 54, DIG. 64, DIG. 37
See application file for complete search history.

(56) References Cited

U.S. PATENT DOCUMENTS

| | | | | |
|---|---|---|---|---|
| 3,596,955 | A * | 8/1971 | Colell | 292/336.3 |
| 3,648,327 | A * | 3/1972 | Edeus | 16/236 |
| 4,342,136 | A * | 8/1982 | Okabe et al. | 292/336.3 |
| 4,681,357 | A * | 7/1987 | Uemura et al. | 292/336.3 |
| 6,264,257 | B1 * | 7/2001 | Meinke | 292/336.3 |
| 6,415,636 | B1 * | 7/2002 | Fukumoto et al. | 70/208 |
| 6,820,925 | B2 * | 11/2004 | Nanaumi et al. | 296/187.05 |
| 6,923,481 | B2 * | 8/2005 | Bruderick et al. | 292/336.3 |
| 7,104,575 | B2 * | 9/2006 | Kakita | 292/348 |
| 7,163,240 | B2 * | 1/2007 | Odahara | 292/347 |
| 7,226,096 | B2 * | 6/2007 | Ito et al. | 292/336.3 |
| 7,344,168 | B2 * | 3/2008 | Matsubara et al. | 292/336.3 |
| 2006/0032277 | A1 * | 2/2006 | Molzer et al. | 70/210 |
| 2007/0007776 | A1 * | 1/2007 | Beard et al. | 292/327 |

FOREIGN PATENT DOCUMENTS

JP 2004-176478 A 6/2004

* cited by examiner

*Primary Examiner* — Robert J Sandy
*Assistant Examiner* — Faria Ahmad
(74) *Attorney, Agent, or Firm* — Carrier Blackman & Associates, P.C.; William D. Blackman; Joseph P. Carrier

(57) ABSTRACT

A vehicle door handle device whereby a door is kept in a locked state by a locking device even if excessive external force is applied to an operation handle. A vehicle door handle device includes a handle base with which an operation handle and a cable are integrated. The handle base has a first portion including a securing part fixed to a door panel, and a second portion including a handle attachment part and a cable fixing part. The handle base further has a weak part between the first portion and the second portion, the weak part being designed to have lower rupture strength than these portions.

8 Claims, 7 Drawing Sheets

VEHICLE DOOR HANDLE DEVICE

FIELD OF THE INVENTION

The present invention relates to a vehicle door handle device and, more particularly, to an improved door handle device in which the locked state of a vehicle door is maintained by a locking device.

BACKGROUND OF THE INVENTION

A vehicle door handle device is used to operate a locking device to unlock a door from a vehicle body, and is attached to a door panel. There are two kinds of such devices: an inside door handle device and an outer side door handle device. In an inside door handle device, the door is opened and closed by operating an operation handle in the passenger compartment. In an outer side door handle device, the door is opened and closed by operating an operation handle on the vehicle exterior. In either device, operative force is transmitted to the locking device by a cable when the operation handle is pulled. As a result, the locked state of the door maintained by the locking device is released.

When the vehicle undergoes a side surface collision, an excessive amount of external force accompanying the collision may act on the door or the operation handle. As a result, the cable may be pulled by the operating handle. When the operating handle is not being operated manually, it is preferred that the locked state of the door is capable of being maintained by the locking device. To accomplish this, it is preferable to ensure that the cable is not pulled by the displaced operating handle. Thus, a structure for attaching a door handle device disclosed in Japanese Patent Application Laid-Open Publication No. 2004-176478 (JP 2004-176478 A), for example, is known as a technique for preventing the cable from being pulled.

The vehicle door handle device attachment structure disclosed in JP 2004-176478 A has a structure whereby an inside door handle device is attached to a door panel and a door trim (door lining). Specifically, the inside door handle device has a structure whereby a handle base consisting of an operating handle and a cable is attached to the door panel and the door trim.

Usually, when an excessive amount of external force acts on the door panel from the exterior during a vehicle side surface collision, the door panel deforms toward the passenger compartment. According to the attachment structure disclosed in JP 2004-176478 A, the handle base splits from the door trim when the door trim peels away from the deformed door panel. Since the handle base is not displaced even if the door trim deforms, the operation handle does not pull on the cable. As a result, the locked state of the door is maintained by the locking device.

However, in the prior art described above, certain objects (e.g., a child seat mounted on the seat) might be placed in the passenger compartment in a position facing the door. The door panel or operation handle that deforms into the passenger compartment by the excessive external force could forcefully collide with the object in the passenger compartment. For example, when the operation handle forcefully hits the object in the passenger compartment, the operation handle might be twisted or displaced relative to the handle base in some other manner, giving rise to a problem wherein the cable is pulled by the displaced operation handle. The same is true for an outer side door handle device.

SUMMARY OF THE INVENTION

It is therefore an object of the present invention to provide a vehicle door handle device whereby the locked state of the door can be maintained by the locking device even when an excessive external force acts on the operation handle According to the present invention, there is provided a vehicle door handle device adapted to be attached to a door panel for operating a locking device to unlock a door from a vehicle body, which device comprises: an operation handle for operating the locking device to perform an unlocking action; a cable for transmitting an operative force of the operation handle to the locking device; and a handle base for integrating the operation handle and the cable, wherein the handle base comprises: a securing part for securing the handle base to the door panel; a handle attachment part for attaching the operation handle; and a cable support part for supporting the cable, and wherein the handle base further includes a weak part formed between a first portion having the securing part and a second portion having the handle attachment part and the cable support part, the weak part being designed to have lower rupture strength than the first portion and the second portion.

In the present invention, in cases in which excessive external force acts on the operation handle when the vehicle undergoes a side surface collision, for example, while the door is locked by the locking device, the external force acts on the second portion from the operation handle via the handle attachment part. The weak part formed between the first portion and the second portion is ruptured by the excessive external force. The second portion having the handle attachment part and the cable support part is divided from the first portion and displaced along with the rupturing of the weak part. The operation handle and the cable are also divided from the first portion and displaced together with the second portion. Therefore, the operation handle is not made to pull on the cable by the excessive external force. Consequently, the locked state of the door can be reliably maintained by the locking device.

Preferably, the weak part comprises a groove provided in such a manner as to divide the first portion and the second portion.

Desirably, the handle base has an intersecting groove formed so as to intersect with the groove, the intersecting groove being designed to have lower rupture strength than the first and second portions.

In a preferred form, at least one of the first portion and the second portion includes a through-hole formed therein, and one end of the intersecting groove is positioned in or proximately to the through-hole.

In a desired form, the door panel has a retraction recess in a position that faces the handle attachment part as the handle base is fixed, the retraction recess being recessed away from the handle attachment part.

It is preferred that the through-hole be formed in the second portion, and the operation handle be attached to the handle attachment part in a state of having been passed through the through-hole.

The handle base may have a decorative cover for covering the handle base from a side facing a passenger compartment. The decorative cover may be designed to be interlocked in the through-hole.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

Figure 1:
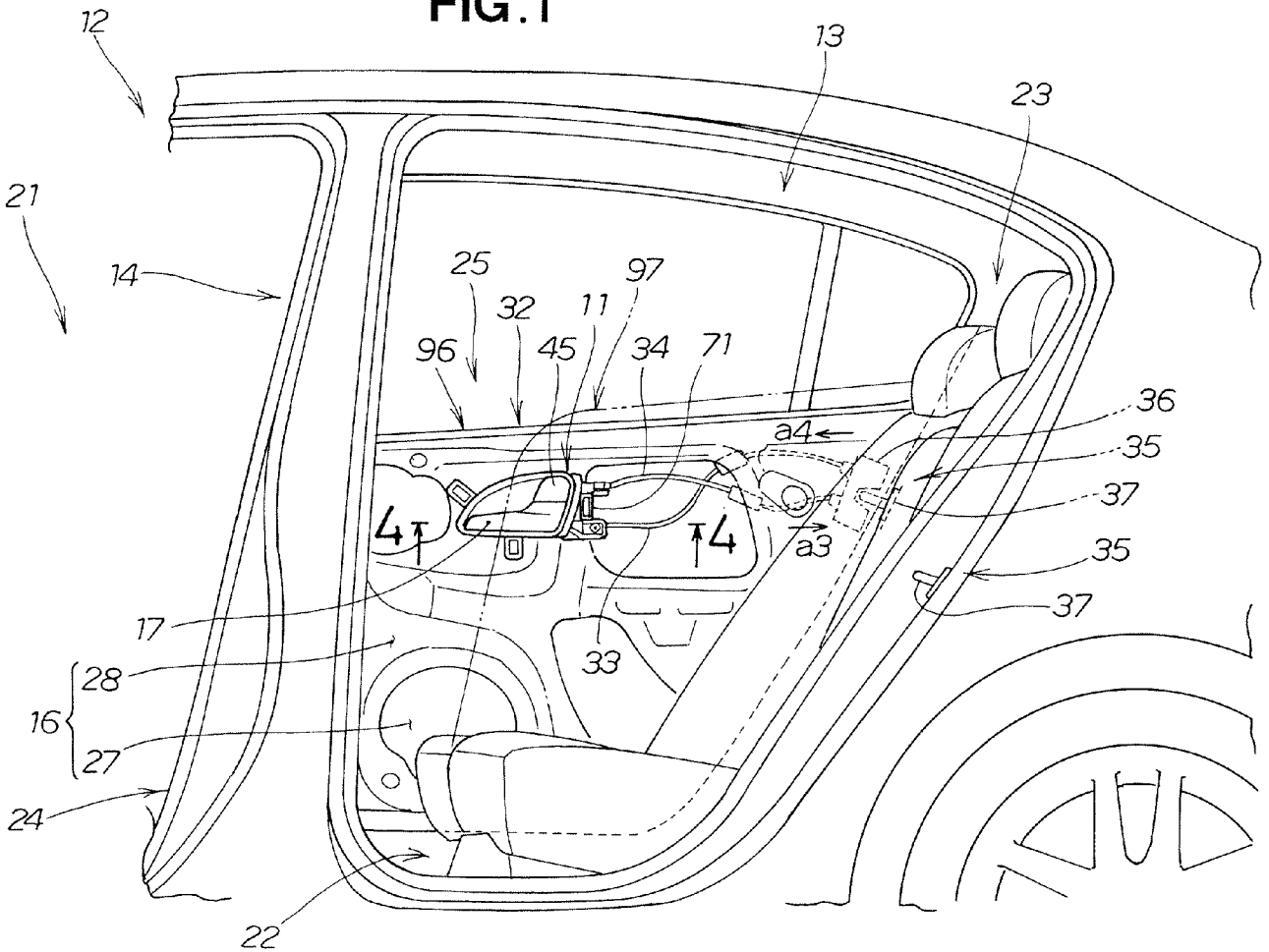
FIG. 1 is a side view illustrating a vehicular door handle device according to an embodiment of the present invention.
Figure 2:
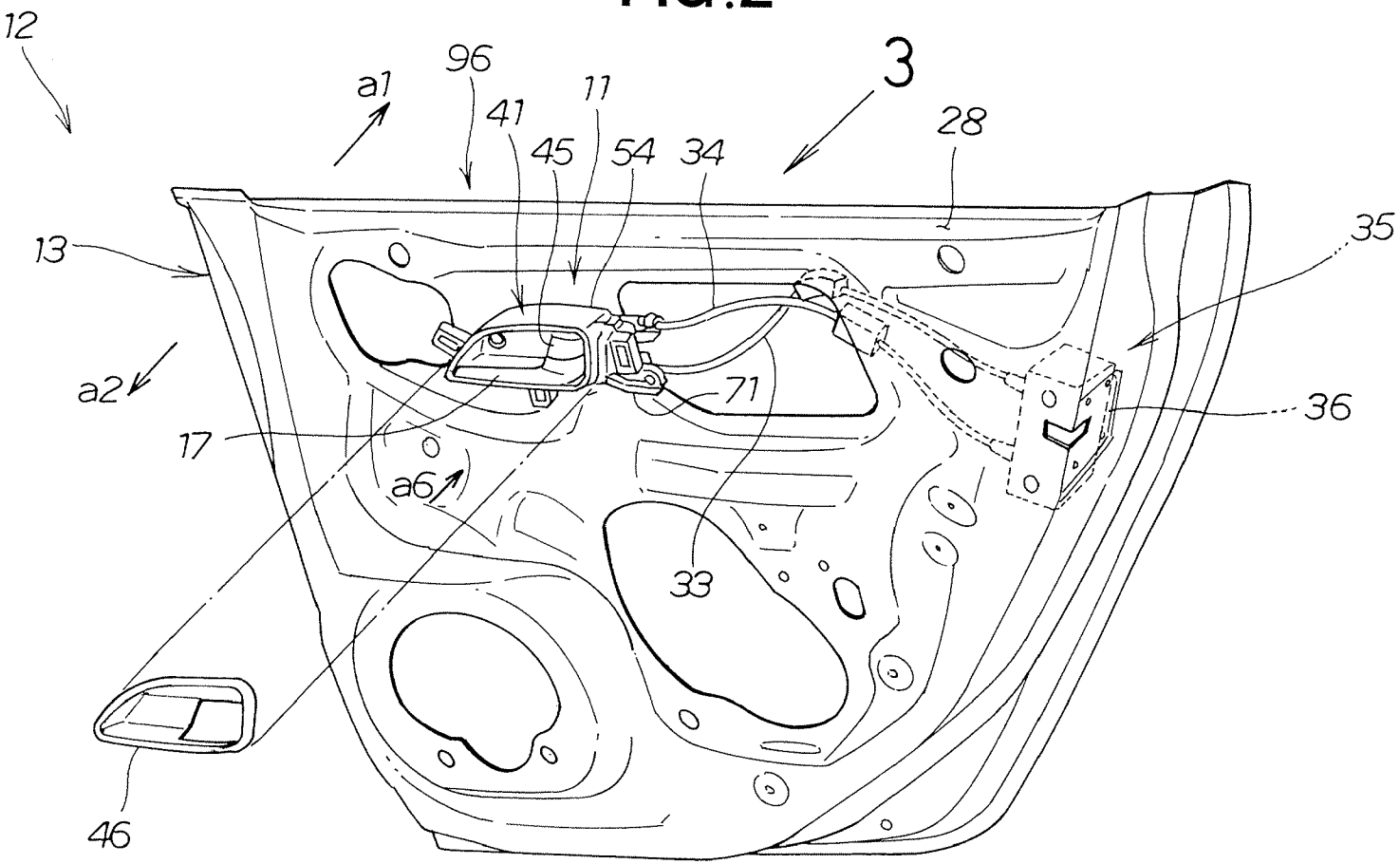
FIG. 2 is a perspective view showing a door with the door handle device of FIG. 1 attached thereto.

A vehicle handle device 11 according to the present embodiment, shown in FIGS. 1 and 2, is used in a vehicle 12 and can be operated from inside a door (rear right door 13) to open the door 13. The vehicle handle device is attached to a door panel 16 of the rear right door 13 supported on a vehicle body 14. By pulling an operation handle 17, the door is released from locking with the vehicle body 14.

The vehicle 12 comprises a passenger compartment 21, an underbody 22 constituting the floor of the passenger compartment 21, a rear seat 23 fixed to the underbody 22, left and right side bodies 24, 24 constituting the side walls of the passenger compartment 21, the rear right door 13 attached in an openable and closable manner to the right side body 24, and a door opening/closing device 25 that includes the door handle device 11.

A door handle device 11 attached to a left rear door (similar to the rear right door 13) not shown in the drawings is identical to the handle device 11 of the rear right door 13.

Figure 4:
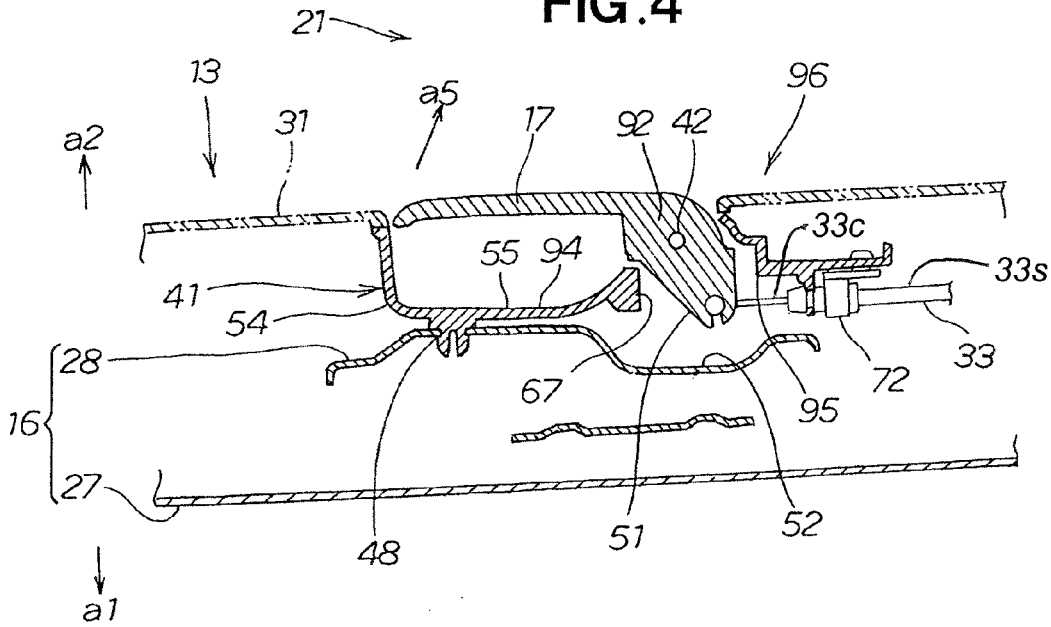
FIG. 4 is a cross-sectional view taken along line 4-4 of FIG. 1.
Figure 5:
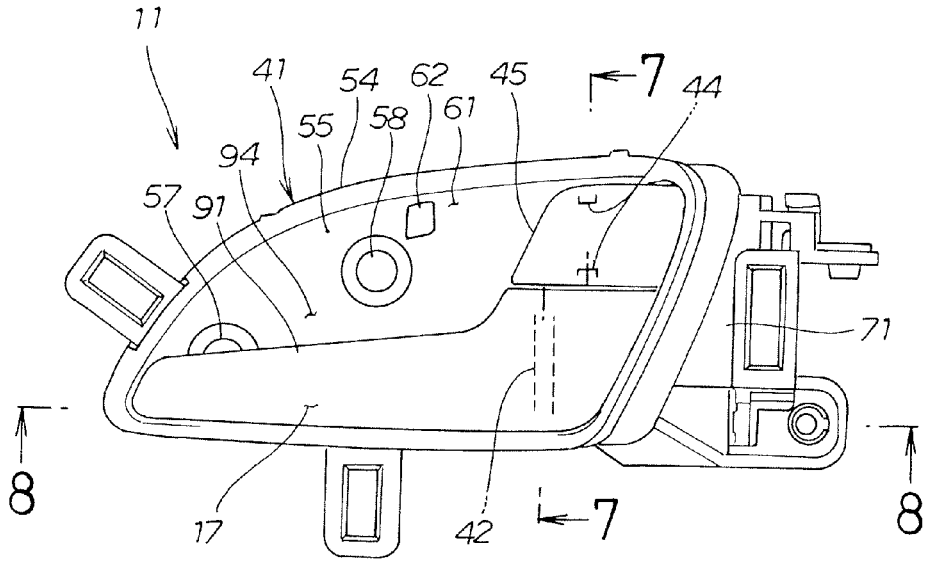
FIG. 5 is a front view of the door handle device of FIG. 2.
Figure 6:
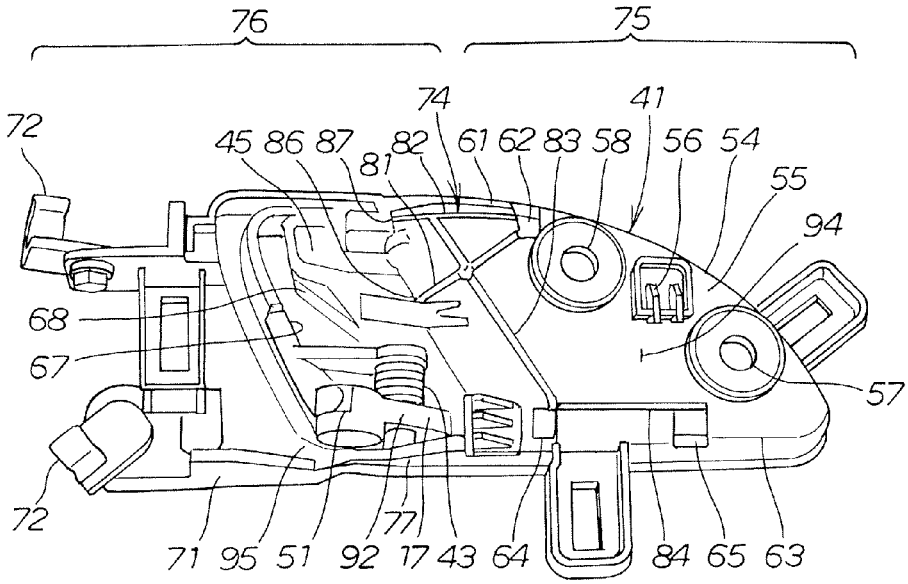
FIG. 6 is a rear view of the door handle device of FIG. 5.
Figure 7:
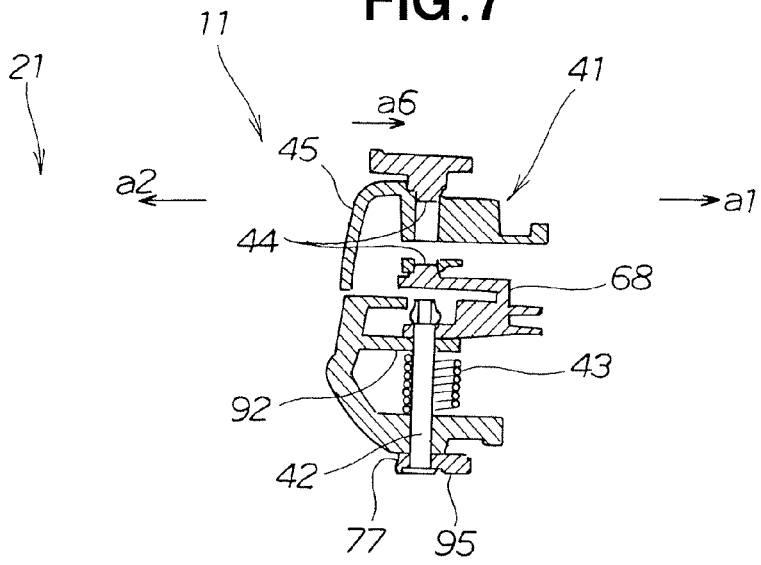
FIG. 7 is a cross-sectional view taken along line 7-7 of FIG. 5.

The rear right door 13 comprises an outer panel 27 disposed toward the outside of the vehicle 12 (in the direction of the arrow a1) shown in FIGS. 2 and 4, an inner panel 28 attached to the outer panel 27 toward the inside of the vehicle 12 (in the direction of the arrow a2), a resinous interior member 31 (FIG. 4) attached to the front surface of the inner panel 28 (the surface facing into the passenger compartment 21), and a rear door opening/closing device 32 included in the door opening/closing device 25.

The rear door opening/closing device 32 comprises an outer side door handle device (not shown) provided to the outer panel 27 of the rear right door 13 and operated from the vehicle exterior, the door handle device (inside door handle device) 11 provided to the inner panel 28 of the rear right door 13, and a locking device 35 linked to the door handle device 11 by an open cable 33 and a locking cable 34 and also linked to the outer side door handle device, each of the cables 33, 34 including an operative inner part and an outer sheath, as exemplified by the inner part 33*c* and the outer sheath 33*s* shown in FIG. 4.

The locking device 35 has an existing configuration, having a lock mechanism 36 fixed to the inner panel 28 and a striker 37 made to lock with the lock mechanism 36 and fixed to the right side body, wherein the locking device 35 locks when the locking cable 34 of the door handle device 11 is pushed (in the direction of the arrow a3 in FIG. 1) and unlocks when the locking cable 34 is pulled, and the lock is released when the open cable 33 of the door handle device 11 is pulled (in the direction of the arrow a4 in FIG. 1).

The door handle device 11 comprises a handle base 41 attached to the inner panel 28, the operation handle 17 attached to the handle base 41 to be capable of swinging (in the direction of the arrow a5) via a fulcrum shaft 42 (FIG. 8), a return spring 43 for returning the operation handle 17 to its original position B, a locking operation part 45 attached to the handle base 41 to be capable of swinging (in the direction of the arrow a6 in FIG. 2) via fulcrum bosses 44 (see FIGS. 7 and 9), and a decorative cover 46 (FIG. 2) for covering the handle base 41 from the side facing the passenger compartment 21, as shown in FIGS. 1 through 9.

Figure 3:
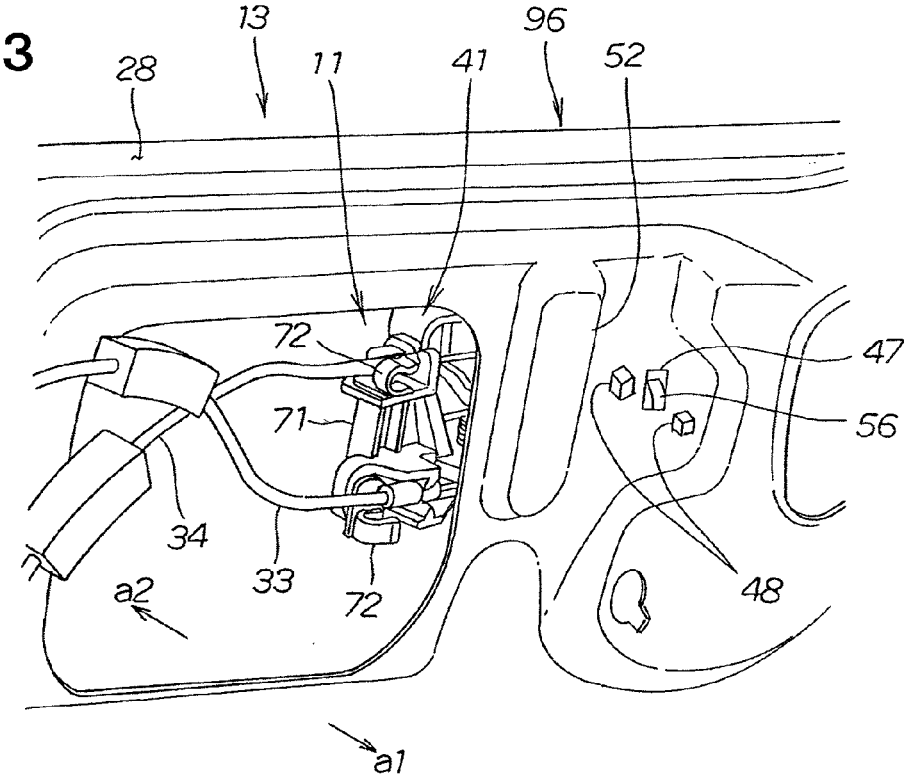
FIG. 3 is a view of the door as seen in the direction of arrow 3 of FIG. 2.

Formed in the inner panel 28 are a positioning hole 47 for positioning the handle base 41 of the door handle device 11 in FIGS. 3 and 4, a base-fastening hole 48 for fastening the handle base 41 in proximity to the positioning hole 47, and an escape recess 52 formed in a range facing a cable-interlocking end 51 of the operation handle 17.

In the handle base 41, a box-shaped base main body 54 is formed, a positioning convexity 56 for fitting into the previously described positioning hole 47 of the inner panel 28 is formed in a bottom part 55 of the base main body 54, the positioning convexity 56 being disposed as protruding toward the vehicle exterior as seen from the passenger compartment 21; a first fastening hole 57 and second fastening hole 58 are opened in the bottom part 55 in proximity to the positioning convexity 56, a first interlocking hole 62 for interlocking with the decorative cover 46 is opened in the bottom part 55 and an upper angle part 61 in proximity to the second fastening hole 58, a second interlocking hole 64 for interlocking with the decorative cover 46 is opened in the bottom part 55 and a lower angle part 63 in a position linearly distanced from the first interlocking hole 62 and below the second fastening hole 58, and a third interlocking hole 65 for interlocking with the decorative cover 46 is opened in the bottom part 55 and the lower angle part 63 in a position linearly separated from the second interlocking hole 64 and in proximity to the first fastening hole 57, as shown in FIGS. 2 through 9.

In the handle base 41, an opening 67 is formed in the bottom part 55 a predetermined distance toward the locking device 35 from the first interlocking hole 62 and the second interlocking hole 64 shown in FIGS. 6 through 10, the operation handle 17 and the locking operation part 45 are passed through the opening 67, a center fulcrum support part 68 supporting one end of the fulcrum shaft 42 and provided with one of the fulcrum bosses 44 is formed in the center of the opening 67, a cable-fixed part 71 is formed at one end of the base main body 54 continuous with the opening 67, a cable clamp 72 is attached to the cable-fixed part 71 and to the outer sheath of the open cable 33, a weak part 74 (see FIG. 6) is formed on the back of the bottom part 55, and a fixed remnant 75 and handle integrating/separating part 76 are provided, their border being the weak part 74 or the vicinity of the weak part 74. The numerical symbol 77 denotes a fitting part for fitting with and holding the other end of the fulcrum shaft 42.

The phrase "the back of the bottom part 55" refers to the side opposite the surface of the bottom part 55 that faces the passenger compartment 21.

The weak part 74 is a groove formed in the bottom part 55, and is composed of a first groove 81, a second groove 82, a third groove 83, and a fourth groove 84. The first groove 81 is formed up to the first interlocking hole 62 from a first edge 86 of the opening 67 adjacent to the center fulcrum support part 68. The second groove 82 is formed up to the first interlocking hole 62 from a second edge 87 of the opening 67 continuous with the first edge 86. The third groove 83 is formed from the longitudinal center of the second groove 82 up to the second interlocking hole 64, and intersects with the longitudinal center of the first groove 81. The fourth groove 84 is formed from the second interlocking hole 64 up to the third interlocking hole 65.

The groove (weak part 74) has a U shape in cross section, but may also have a shape other than a U. For example, the groove can have a V shape.

In one example of the weak part 74, the third groove 83 as well as the second interlocking hole 64 or the third interlocking hole 65 rupture under a desired load (external force), whereby the handle base 41 splits and the handle integrating/separating part 76 is formed in a state of holding the operation handle 17.

Figure 8:
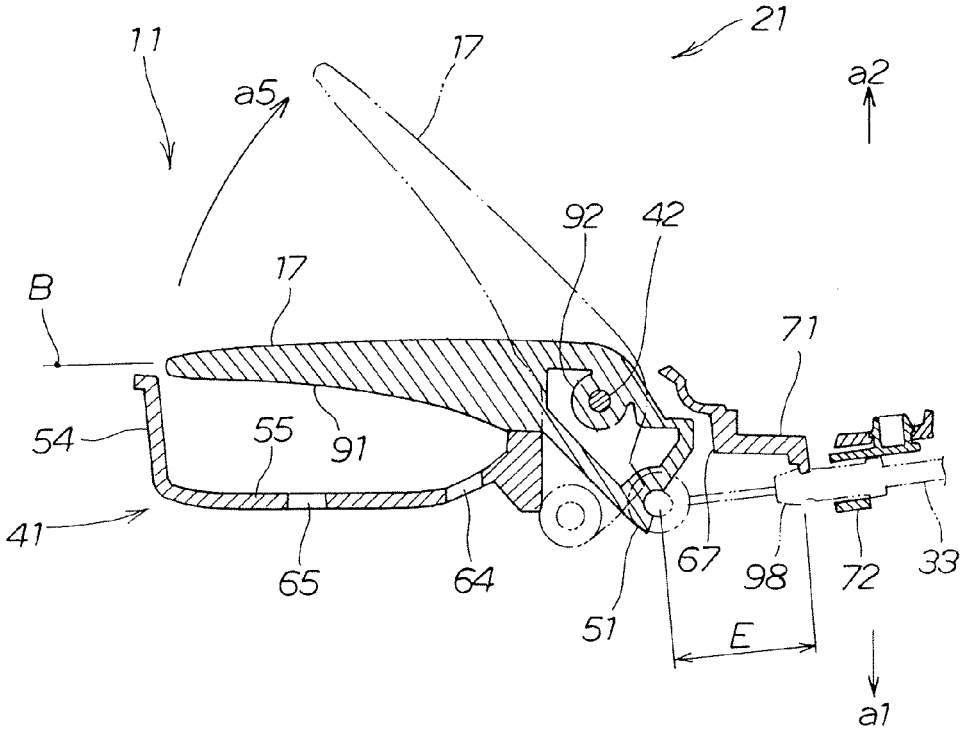
FIG. 8 is a cross-sectional view taken along line 8-8 of FIG. 5.
Figure 9:
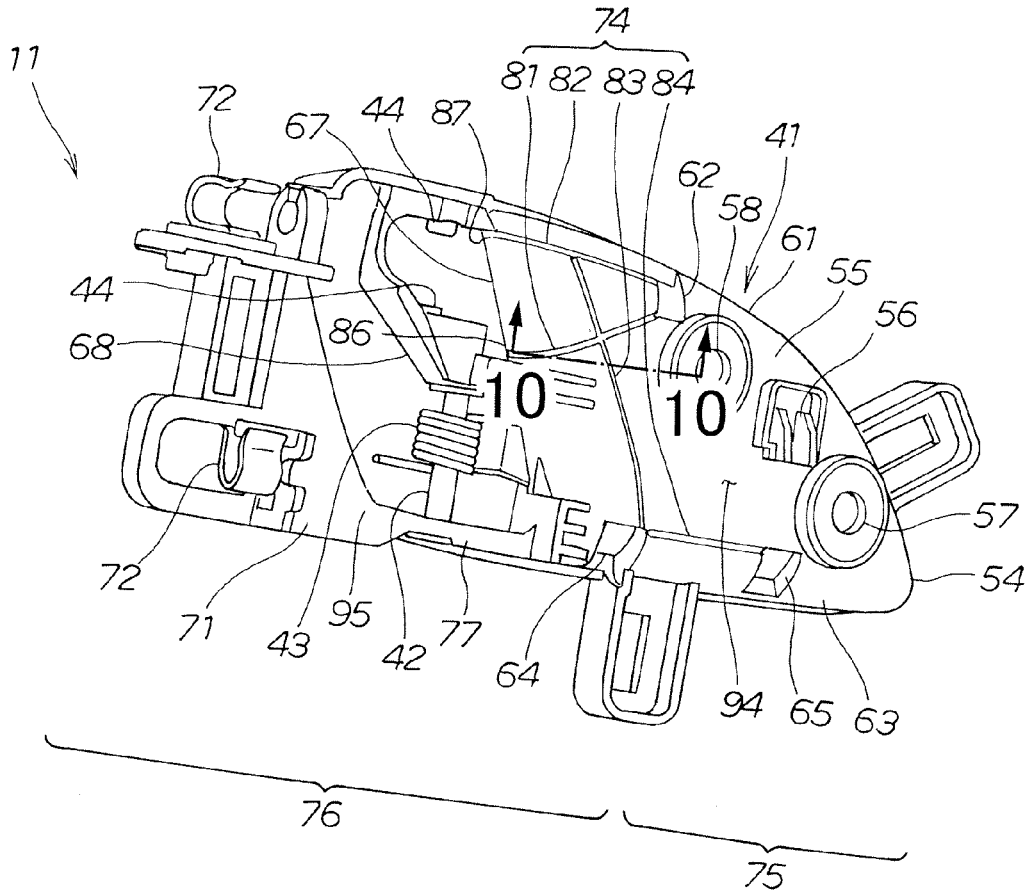
FIG. 9 is a perspective view similar to FIG. 6, showing the door handle device of FIG. 6.
Figure 10:
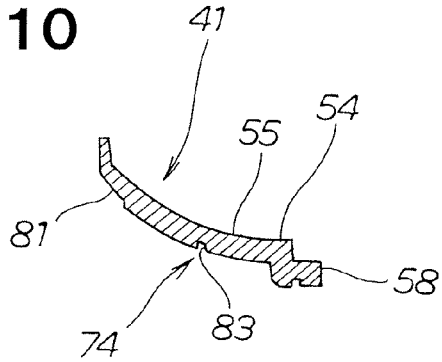
FIG. 10 is a cross-sectional view taken along line 10-10 of FIG. 9.

The operation handle 17 is composed of a handle operating part 91 operated (in the direction of the arrow a5) by a vehicle occupant in the passenger compartment 21, a fulcrum part 92 into which the fulcrum shaft 42 rotatably fits, and a cable-interlocking end 51 which interlocks with the open cable 33, as shown in FIG. 8.

In the handle integrating/separating part 76, the center fulcrum support part 68 of the handle base 41, the cable-fixed part 71, the fulcrum shaft 42, the operation handle 17 supported by the fulcrum shaft 42, and the locking operation part 45 are not separated as a result of the split in the handle base 41, but constitute a single cluster which remains together as an assembly after such split.

Thus, in order to release the locking device 35 locking the rear right door 13 to the vehicle body 14, the door handle device 11 has the operation handle 17 for releasing the locking device 35, the operation handle 17 being attached to the door panel (the inner panel 28) in the rear right door 13; the open cable 33 for transmitting operative force (in the direction of the arrow a5 in FIG. 8) of the operation handle 17 to the locking device 35, and the handle base 41 with which the operation handle 17 and the open cable 33 are integrated.

The handle base 41 has a securing part 94 (including the first fastening hole 57 and the second fastening hole 58) for securing the handle base 41 to the inner panel 28, a handle attachment part 95 (including the center fulcrum support part 68 and the rear frame 77) for attaching the operation handle 17, and the cable-fixed part 71, which is a cable support part for supporting the open cable 33. The weak part 74 is formed on the handle base 41 between the fixed remnant 75 located in a first portion having the securing part 94, and the handle integrating/separating part 76 as a second portion having the handle attachment part 95 and the cable support part (the cable-fixed part 71). The weak part 74 is designed to have lower rupture strength than the first portion (the fixed remnant 75) and the second portion (the handle integrating/separating part 76).

The weak part 74 is configured from a groove (the third groove 83) positioned so as to divide the first portion (the fixed remnant 75) and the second portion (the handle integrating/separating part 76). Due to the presence of the third groove 83 extending across the handle base 41, the weak part 74 is formed thinner than adjacent parts of the handle base.

The handle base 41 has intersecting grooves (the first groove 81, the second groove 82, and the fourth groove 84) formed so as to intersect with the third groove 83. The intersecting grooves (the first groove 81, the second groove 82, and the fourth groove 84) are designed to have lower rupture strength than the first portion (the fixed remnant 75) and the second portion (the handle integrating/separating part 76).

A plurality of first through-holes (the first interlocking hole 62, the second interlocking hole 64, and the third interlocking hole 65) is formed in the first portion (the fixed remnant 75), a second through-hole (the opening 67) is formed in the second portion (the handle integrating/separating part 76), and the intersecting grooves (the first groove 81, the second groove 82, and the fourth groove 84) extend up to the through holes (the third interlocking hole 65 through to the first interlocking hole 62 and the opening 67).

It is possible to form through holes only in at least one of the first portion (fixed remnant 75) and the second portion (the handle integrating/separating part 76). For example, the second through-hole (the opening 67) is formed only in the second portion (the handle integrating/separating part 76), and a plurality of first through-holes (the first, second, and third interlocking holes 62, 64, 65) is not formed in the first portion (the fixed remnant 75). Under these conditions, the intersecting grooves (the first groove 81, the second groove 82, and the fourth groove 84) extend from the second through hole (the opening 67) up at an angle in the bottom part 55.

The intersecting grooves (the first groove 81, the second groove 82, and the fourth groove 84) can also extend from the angle in the bottom part 55 up to the vicinity of the through-holes (the third, second, and first interlocking holes 65, 64, 62, and the opening 67).

In a handle device attachment structure 96 (FIG. 1) whereby the door handle device 11 is attached to the door panel (the inner panel 28), the inner panel 28 has a retraction recess (the escape recess 52 in FIG. 4) at a position that faces the handle attachment part 95 (FIG. 4) when the handle base 41 is fixed. This retraction recess 52 is recessed away from the handle attachment part 95 (in the direction of the arrow a1 in FIG. 4) in the inner panel 28.

Next, the action of the embodiment of the present invention will be described with reference to FIGS. 1 through 11.

Figure 11:
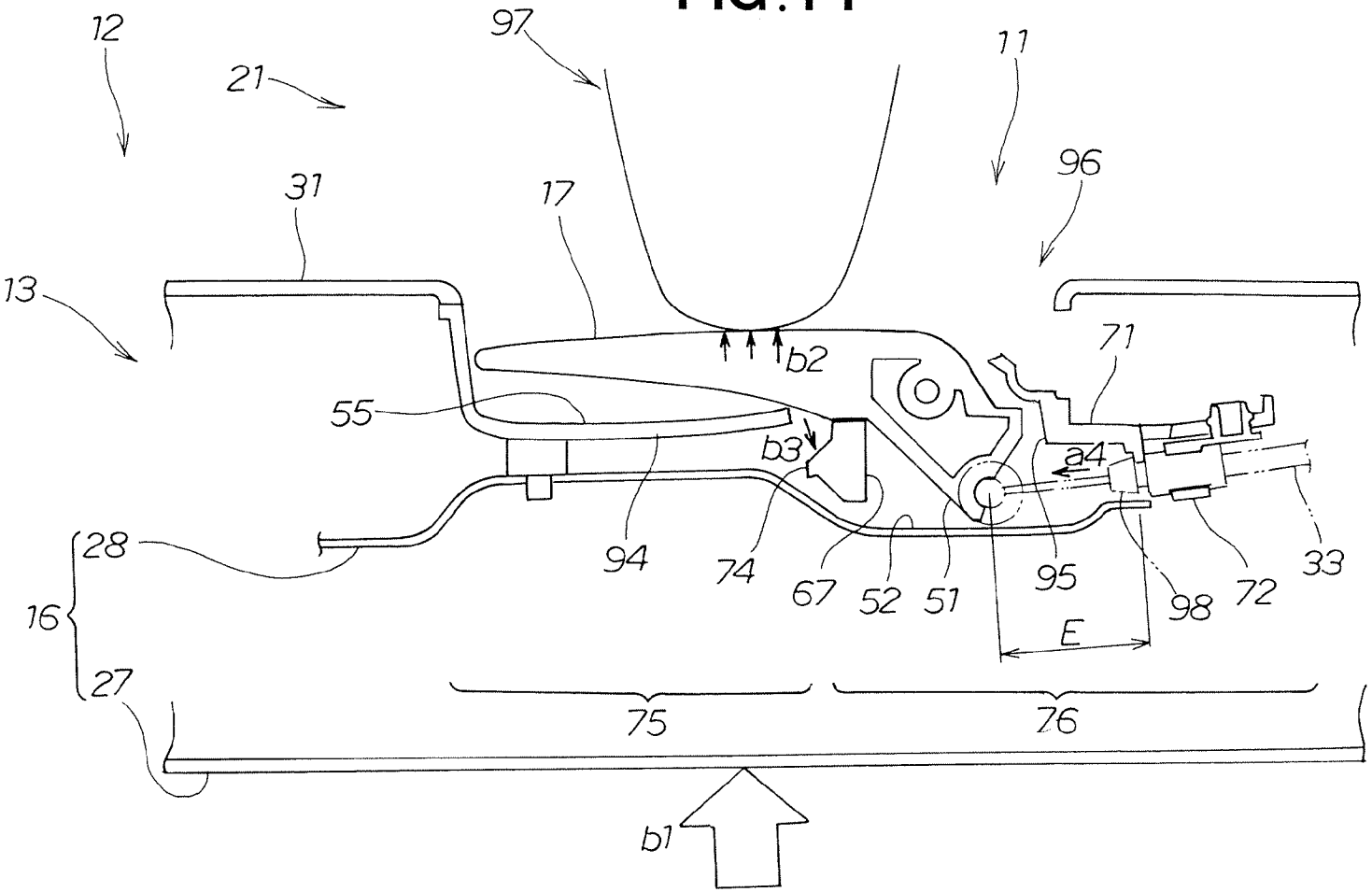
FIG. 11 is a schematic view showing a mechanism whereby the locked state is maintained under external force acting on the door handle device.

In a vehicle 12 in which a child seat 97 is secured to the rear seat 23 as shown in FIG. 1, when external force from another vehicle acts on the side surface of the vehicle 12 as indicated by the arrow b1 (FIG. 11), the child seat 97 and the door handle device 11 (inside door handle device) of the rear right door 13 shown in FIG. 11 might interfere with each other as indicated by the arrow b2, damaging the door handle device 11.

At such a time, the door handle device 11 (inside door handle device) ruptures in the weak part 74, whereby the second portion (handle integrating/separating part 76) having the handle attachment part 95 and the cable support part (cable-fixed part 71) can be divided and displaced relative to the first portion (the fixed remnant 75) as indicated by the arrow b3. As a result, there is no change in the distance E from the cable-interlocking end 51 of the operation handle 17 to the end 98 of the open cable 33 fixed to the cable-fixed part 71. Therefore, the open cable 33 is not pulled (in the direction of the arrow a4) as a consequence of a rupture of the handle base 41 and the consequent separation of the first and second portions 75, 76, and the locking device 35 can be prevented from being operated in the direction of releasing the lock.

The vehicle handle device of the present invention is disposed on the passenger compartment side of a door in the embodiment, but can also be used in the outer side of the door.

The locking operation part 45 is rotatably disposed adjacent to the operation handle 17, but may also be disposed at a distance from the operation handle 17, and may be configured to move linearly without rotating.

The vehicle handle device of the present invention is suitable for a door handle device operated from inside the passenger compartment.

Obviously, various minor changes and modifications of the present invention are possible in light of the above teaching.

It is therefore to be understood that within the scope of the appended claims the invention may be practiced otherwise than as specifically described.

What is claimed is:

1. A vehicle door handle device adapted to be attached to a door panel for operating a locking device to unlock a door from a vehicle body, said vehicle door handle device comprising:

an operation handle for operating the locking device to perform an unlocking action;

a cable for transmitting an operative force of the operation handle to the locking device; and a handle base for integrating the operation handle and the cable, wherein the handle base comprises:

a securing part for securing the handle base to the door panel;

a handle attachment part for attaching the operation handle; and a cable support part for supporting the cable, and wherein the handle base further includes a weak part formed between a first portion having the securing part thereon and a second portion having the handle attachment part and the cable support part thereon, the weak part being formed thinner than adjacent parts of the handle base and designed to have lower rupture strength than the first portion and the second portion, such that the handle base is configured and arranged to rupture at the weak part when subjected to a predetermined amount of external force, to separate the second portion from the first portion, such that after the first and second portions of the handle base are separated by said rupture, the handle attachment part and the cable support part will substantially remain in a predetermined positional relationship with respect to each other, thereby preventing operation of said locking device.

2. The door handle device of claim 1, wherein the weak part comprises a separation groove formed in the handle base and provided in such a manner as to divide the first portion and the second portion when said force is applied to the handle base.

3. The door handle device of claim 2, wherein the handle base has an intersecting groove formed therein so as to intersect with the separation groove, and the intersecting groove is designed to have lower rupture strength than the first and second portions.

4. The door handle device of claim 3, wherein at least one of the first portion and the second portion includes a through-hole formed therein, and one end of the intersecting groove is positioned in or proximately to the through-hole.

5. The door handle device of claim 1, wherein the door panel has a retraction recess in a position that faces the handle attachment part as the handle base is fixed, the retraction recess being recessed away from the handle attachment part.

6. The door handle device of claim 4, wherein the through-hole is formed in the second portion, and the operation handle is attached to the handle attachment part in a state of having been passed through the through-hole.

7. The door handle device of claim 4, wherein the handle base has a decorative cover for covering the handle base from a side facing a passenger compartment, the decorative cover being designed to be interlocked in the through-hole.

8. The door handle device of claim 1, wherein the cable includes an operative inner part and an outer sheath, and the cable support part is secured to the outer sheath of the cable.

* * * * *